US005276424A

United States Patent [19]

Hegemann

[11] Patent Number: 5,276,424

[45] Date of Patent: Jan. 4, 1994

[54] ATTENTION GETTING SIGN

[76] Inventor: John J. Hegemann, 810 S. Kolb Rd., #43, Tucson, Ariz. 85710

[21] Appl. No.: 9,556

[22] Filed: Jan. 25, 1993

Related U.S. Application Data

[63] Continuation-in-part of Ser. No. 871,074, Apr. 20, 1992, abandoned.

[51] Int. Cl.[5] ..... G08B 5/38; H05B 43/00

[52] U.S. Cl. ..... 340/321; 40/586; 362/109; 362/183

[58] Field of Search ..... 340/473, 908, 906, 321; 40/586; 362/109, 183; 320/2; 136/291; 200/61.52; 116/DIG. 36, 116/202, 346/321

[56] References Cited

U.S. PATENT DOCUMENTS

| | | | |
|---|---|---|---|
| 1,842,474 | 1/1932 | Higby | 40/580 |
| 1,975,690 | 10/1934 | Harrington et al. | 40/580 |
| 2,564,145 | 8/1951 | Beall et al. | 340/908 |
| 2,707,346 | 5/1955 | Fuller, Jr. | 40/580 |
| 3,075,174 | 1/1963 | Orszulak | 340/908 |
| 3,769,472 | 10/1973 | Bell et al. | 200/61.52 |
| 4,006,452 | 2/1977 | Giacino | 200/61.52 |
| 4,009,535 | 3/1977 | Stock | 116/DIG. 36 |
| 4,042,919 | 8/1977 | Patty . | |
| 4,108,405 | 8/1978 | Gibson | 116/DIG. 36 |
| 4,209,917 | 11/1981 | Ware . | |
| 4,447,802 | 5/1984 | Bose . | |
| 4,481,562 | 11/1984 | Hickson | 362/183 |
| 4,922,223 | 5/1990 | Prevot | 340/473 |
| 4,998,366 | 3/1991 | Richard | 40/425 X |
| 5,001,455 | 3/1991 | Starchevich . | |
| 5,097,612 | 3/1992 | Williams . | |

*Primary Examiner*—Daniel M. Yasich
*Attorney, Agent, or Firm*—Ogram & Teplitz

[57] ABSTRACT

A handheld sign having printing and shape suggestive of certain activities, such as a "stop" sign, and further having at least two lights in which only a single light is illuminated at any one time. The flashing between the lights provides added attention getting capability and hence more safety. The lights are powered by a battery pack which is preferably rechargeable through normal household current, a solar radiation collecting apparatus mounted onto the sign, or via an automobile cigarette lighter.

24 Claims, 3 Drawing Sheets

ATTENTION GETTING SIGN

BACKGROUND OF THE INVENTION

This is a continuation-in-part of U.S. patent application Ser. No. 07/871,074, filed Apr. 20, 1992, now abandoned and entitled "Britney Safety Light".

This invention relates generally to signs and more specifically to handheld signs.

Communication of thoughts, suggestions, and orders relies heavily upon the ability to get the attention of the potential "listener". If little or no attention is given the message by the viewer, the message is lost.

This need for additional attention gathering capability is most pronounce in the automotive setting where the driver of the vehicle, especially in a crowed city setting, is faced with almost an overload of stimulus from the other vehicles, traffic signals, traffic signs, wandering pedestrians, and many other sources. If important messages to the driver are lost in this noisy environment, accidents are bound to occur.

To gain the attention of the driver, a variety of devices have been developed which strive to rise above the noise. One such device is described in U.S. Pat. No. 5,097,612, entitled "Illuminated Traffic Control Sign" issued to Williams on Mar. 24, 1992. This apparatus creates a flashing arrow sign so as to direct the drivers to the correct course around a stalled vehicle. This apparatus though is attached to a vehicle and as such it does not provide protection for pedestrians.

A more portable type of attention getting device is described by U.S. Pat. No. 4,447,802, entitled "Warning Light" issued to Bose on May 8, 1984. This device is a folding light arrangement which is used to mark or warn of stranded vehicles. The light, when erected and activated, flash lights to gain the attention of nearby vehicles. The lights only draw attention, they do not communicate the type of emergency involved or what steps should be taken; and, the lights themselves are not easily used by pedestrians.

One device which specifically address the needs of a pedestrian, obtaining visibility from passing vehicles, is described by U.S. Pat. No. 5,001,455, entitled "Portable Signaling Device" issued to Starchevich on Mar. 19, 1991. This patent describes a hand-held apparatus which is illuminated to display the word "TAXI" so that a taxi-cab may be hailed.

Although this device, through its illumination, does obtain a certain level of attention, the level of attention actually achieved is relatively minor.

The need for obtaining a large level of attention is most pronounce in a child-crossing situation when a guard or escort "secures" the traffic intersection for small children to pass. Although the guard/escort is equipped with a bright red handheld sign bearing the legend "STOP", many times these signs are lost in the noise of the street and vehicles fail to stop. This endangers the guard/escort and his charges.

Recognizing this limitation to the handheld signs, U.S. Pat. No. 4,042,919, entitled "Illuminated Sign and High Intensity Warning Device" issued to Patty on Aug. 16, 1977, was issued. In this patent, a standard flashlight is used to back-illuminate a hexagonal shaped "STOP" sign. An additional strobe light is attached to the top of the device to provide even further attention getting capability.

Unfortunately, the back-illumination sometimes tends to blend with other lights in the driving environment.

More pronounce illumination is not available due to the light source a handheld flashlight. Further, the strobe light consumes a large amount of electrical energy; thereby consuming the batteries at such a high rate that use of the strobe is avoided.

Flashing lights do draw more attention and several patents have tried to utilize this technique. U.S. Pat. No. 4,209,917, entitled "Motion Light Device" issued to Ware on Nov. 3, 1981, describes a device which flashes the lights based upon a motion sensing switch. If this is incorporated into a handheld sign, to maintain a flashing affect, the user would have to keep the sign "jiggling" so that the switch continues to flash the lights. If the user holds the sign relatively still, such as in the center of the cross-walk waiting for children to complete their journey across the street, the lights would go to a constant "on" state and thereby loose their attention getting capability.

It is clear from the foregoing that an attention getting handheld sign is needed and required in certain situations for safety purposes.

SUMMARY OF THE INVENTION

The invention is a handheld sign having printing and shape suggestive of certain activities, such as a "STOP" sign, and further having at least two lights in which only a single light is illuminated at any one time. The flashing of the lights provide added attention getting capability and hence more safety. The lights are powered by a battery pack which is preferably rechargeable through normal household current, a solar radiation collecting apparatus mounted onto the sign, or an automotive cigarette lighter.

Two basic housing components are used by the present invention, a sign housing and a handle housing. The sign housing includes, in the preferred embodiment, two flat surfaces which contain the appropriate legend (i.e. "STOP", "YIELD", "EMERGENCY", etc.) and is shaped to suggest the activity (i.e. a hexagonal shape for "STOP", a triangular shape for "YIELD").

On the flat surfaces are at least two light emitting areas. In the preferred embodiment, two light emitting areas are used, one at the top of the sign and one at the bottom of the sign. Also in the preferred embodiment, the lighted areas are composed of windows having quartz or high intensity bulbs therein.

Access to the light bulbs is through a hinge in the housing permitting one of the surfaces to be rotated out of the way, granting access to the light bulbs. In the preferred embodiment, the two halves for the sign portion are secured to each other via four screws. Removal of these screws permits separation of the two halves and quick access to the bulbs for their replacement.

The handle housing contains an electrical source and rechargeable batteries (in the preferred embodiment). Electrical energy from the source is communicated, via a control unit or circuitry, to only one of the light emitting sources at a time. In the preferred embodiment using two light emitting sources, this means that the lights will blink back and forth. It is this blinking action which gains the required attention.

An alternative method of charging the batteries is through well known recharging techniques from household current. A transformer is used to convert the household voltage to an acceptable voltages for the batteries. Those of ordinary skill in the art readily recognize various methods to accomplish this task.

The useful intent and applications for the safety light so described are:

a) School Crossing Guards:

b) Highway Patrol and Traffic Directors;

c) Disabled Vehicles or Traffic Accidents;

d) Construction Sites, Lane Closures;

e) Driving Under the Influence Check Points;

f) Immigration Check Points;

g) Stadium Parking Lot Traffic Control;

h) Airport Taxi and Ground Vehicle Control;

i) Temporary Traffic Control for Broken Traffic Signal Lights.

Other applications for the sign are in stationary pedestals for warning of wet floors, giving directions for traffic flow, and the like.

The totally self contained handheld or pedestal mounted unit should significantly reduce accidents, injuries and fatalities, when used in any of the above applications. The safety light should also be extremely beneficial in inclement weather and where students travel to school in hours that are still dark (i.e. winter months and Day-Light Saving Time).

The invention, together with various embodiments thereof, will be more fully described by the following drawings and their accompanying descriptions.

DRAWINGS IN BRIEF

FIG. 1A is a frontal view of an embodiment of the invention.

FIGS. 1B, 1C, 1D, and 1E are representations of components of the embodiment illustrated in FIG. 1A.

DRAWINGS IN DETAIL

Figure 1A:
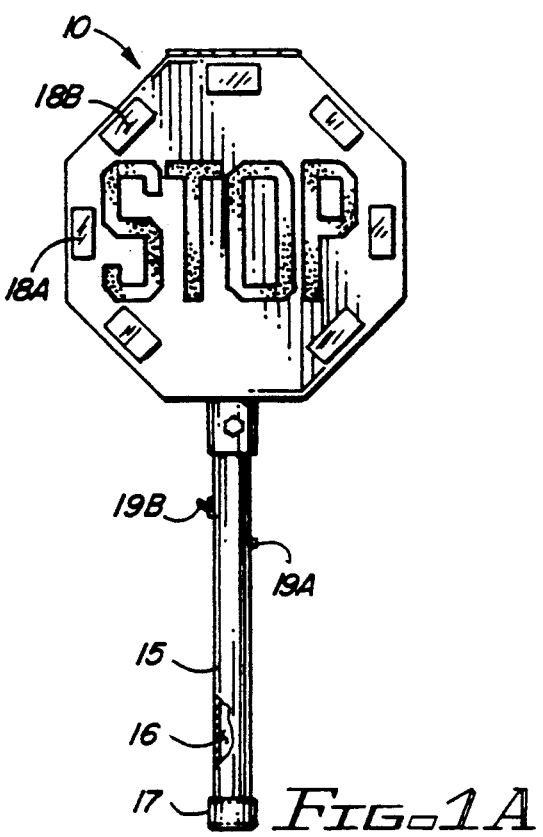
Figure 1B:
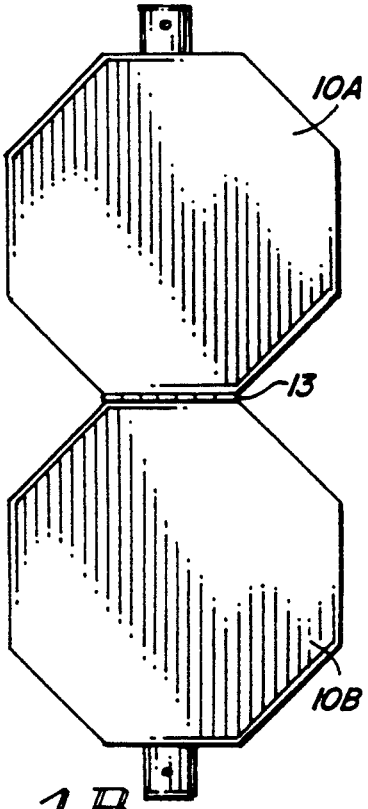

FIG. 1A is a frontal view of an embodiment of the invention.

The invention includes a sign portion lo and a handle portion 15. Sign portion 10, in this embodiment is shaped to simulate a "STOP" sign with its hexagonal shape (and red color- not shown). Around the periphery are illuminated areas or windows such as illuminated areas 18A and 18B. These illuminated areas are designed to draw attention to the sign portion.

In the handle portion 15, is screw-on cover 17 which permits access to battery compartment 16. Toggle switch 19B is used to enable the operation of the lights; but, button switch 19A is used to do the actual activation. That is, toggle switch 19B is switched to an "on" position; but the lights are not activated/lit until the button switch 19A is pushed by the operator, such as when he crosses the road.

FIGS. 1B, 1C, 1D, and 1E are representations of components of the embodiment illustrated in FIG. 1A.

The sign portion 10 is hinged 13 permitting the sign portion to open as illustrated into part 10A and part 10B. This capability permits the enclosed components to be readily accessible (e.g. changing of the light bulbs).

Figure 1C:
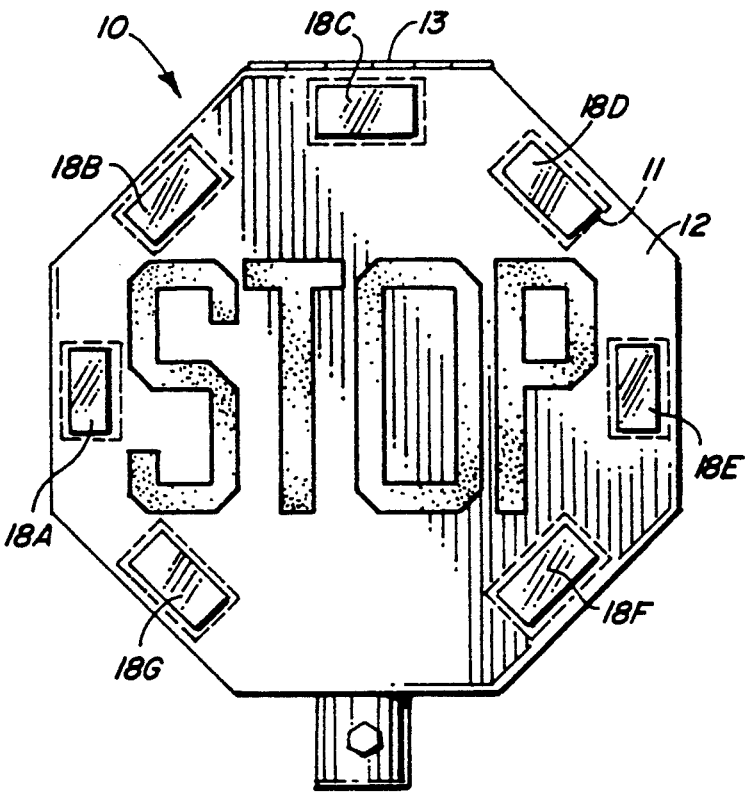

As illustrated in FIG. 1C, sign portion 10 fundamentally appears as a hexagon simulating a "stop" sign having the word "STOP" imprinted thereon. Additionally, in this embodiment, around the periphery of the sign are a plurality of lights 18A, 18B, 18C, 18D, 18E, 18F, and 18G.

Figure 1D:
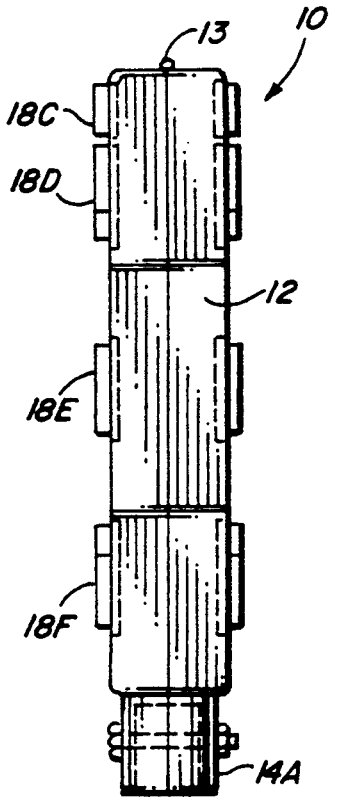

FIG. 1D, a side view of the sign portion illustrate the placement of the handle slot 14A. Handle 14B inserts into handle slot 14A and is secured by a bolt or other suitable mechanism well known to those in the art.

Figure 1E:
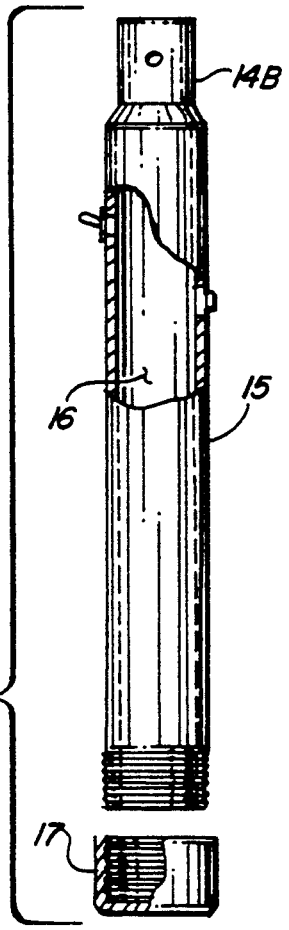

Handle 14B, as shown in FIG. 1E, is fundamentally an 1 3/4 inch round stock with a screw-on cover 17. Batteries, whether rechargeable or disposable, are stored in battery compartment 16.

Figure 2:
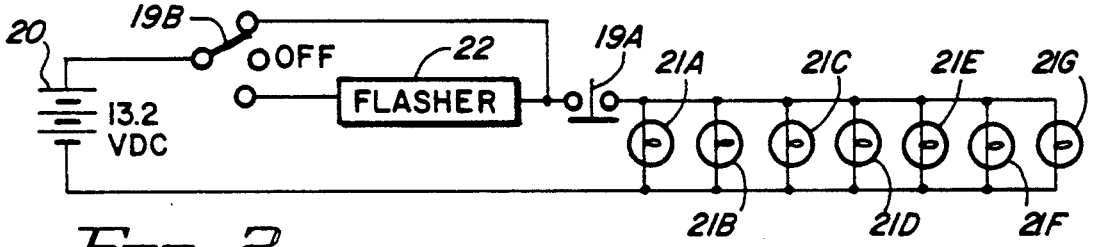
FIG. 2 is an electrical schematic for the embodiment of FIG. 1A.

FIG. 2 is an electrical schematic for the embodiment of FIG. 1A.

Electrical energy from battery 20 is passed to, in this embodiment, high intensity lamps 21A, 21B, 21C, 21D, 21E, 21F, and 21G. High Intensity lamps 21A, 21B, 21C, 21D, 21E, 21F, and 21G, shine through illuminated areas or windows 18A, 18B, 18C, 18D, 18E, 18F, and 18G, respectively.

Activation of toggle switch 19B permits the operator to select if the activation of the lamps is either constant or flashing (via flasher 22). Operator activation of push button switch 19A permits the operator to activate the entire assembly. Push button switch 19A is used when the operator is using the sign to cross the street.

This electrical circuit provides for either constant flashing of all the lights or a constant on for the lights.

Figure 3A:
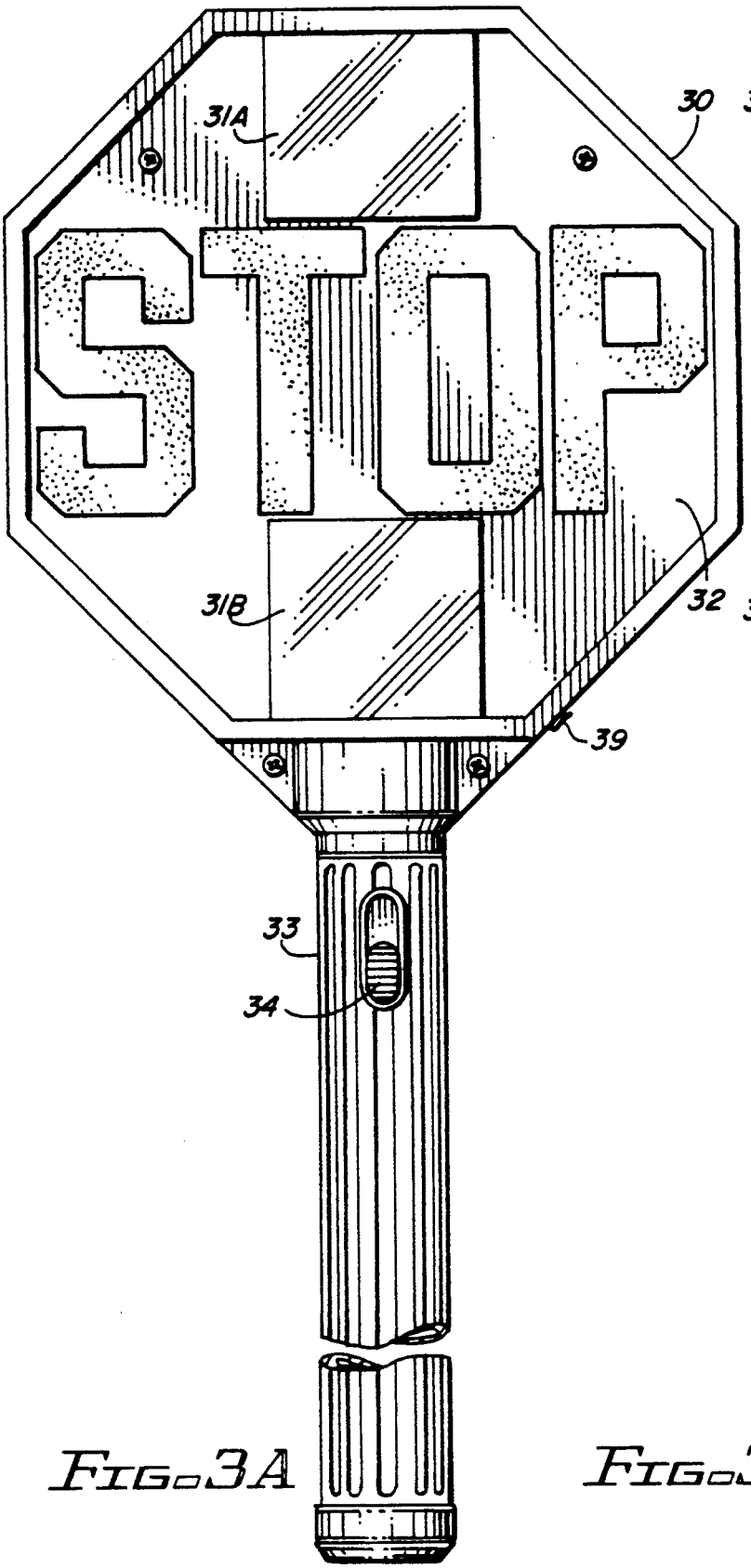
FIG. 3A is a frontal view of the preferred embodiment of the invention.

FIG. 3A is a frontal view of the preferred embodiment of the invention.

In this embodiment, sign 30 is shaped to simulate a stop-sign having a printed portion 32 with the word "STOP". Other embodiments involve the use of other standard shapes and words for other applications (e.g. triangle-"YIELD"; rectangle- "CAUTION").

In the preferred embodiment, two illuminated areas or windows 31A and 31B are used. Through a control circuit, not shown, the lighting of each window is alternated to gain even more attention from passing vehicles.

The sign 30 has two flat surfaces, one on the front (shown) and one on the back (not shown). Each flat surface has a printed portion 32 with, for example, the message "STOP" imprinted on it. Each flat surface also has at least two windows 31A and 31B. Inside the sign 30 are at least two light emitting means (not shown). The light emitting means are positioned to shine light through the window means 31A and 31B. The sign 30 further has an electrical source, for example rechargeable batteries (not shown), and a control means (not shown). The control means alternate electrical flow from the electrical source to first one light emitting means and then to a second light emitting means.

Handle 33, as in the prior embodiment, contains the batteries (not shown) and switch 34. In this embodiment, switch 34 is a three-way switch permitting the selection of either a flashing or constant mode. An additional switch, not shown, is a position sensing switch. Position sensing switch assures that the lights are only illuminated when the sign is held in a substantially upright position (i.e. when crossing the road). A suitable position sensing switch is a mercury switch although those of ordinary skill in the art recognize other switches which serve this function.

Another aspect of the preferred embodiment is the use of a solar energy collector. In the preferred embodiment, the solar collectors are positioned behind the "STOP" wording 32. Solar collectors are used to re-charge the batteries to extend the operating life of the unit and are well known to those of ordinary skill in the art.

Auxiliary power supply connection 39 is used to provide either household current to re-charge the batteries within this embodiment or to provide low voltage which is directly used to illuminate the lamps. This low voltage is supplied from such sources as an auxiliary battery pack worn on a belt or a connection to an automobile's battery (typically via a cigarette lighter).

Figure 3B:
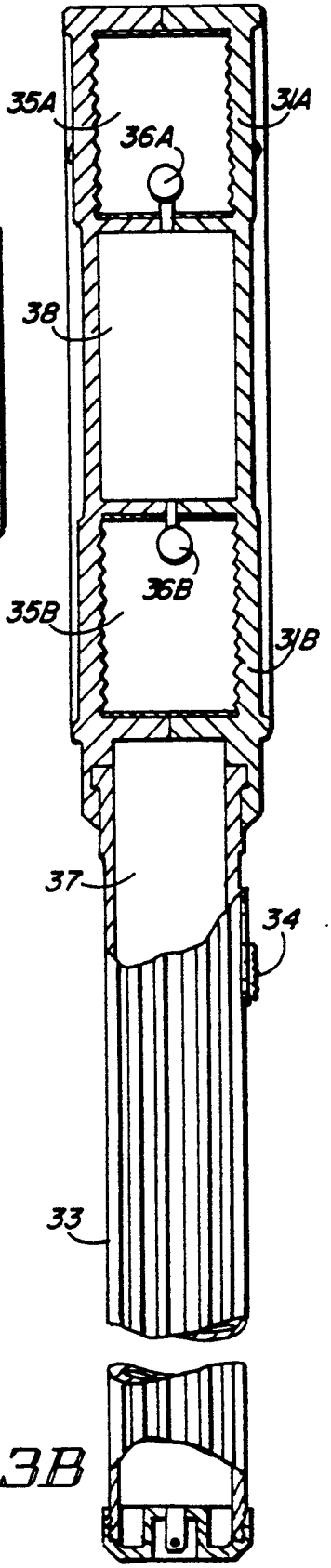
FIG. 3B is a cut-away side view of the preferred embodiment of the invention.

FIG. 3B is a cut-away side view of the preferred embodiment of the invention.

Handle 33 holds battery compartment 37 and switch 34.

Light compartments 35A and 35B each holds a quartz lamp (36A and 36B) and are mirrored to increase the illuminating capability.

Compartment 38 contains the controlling mechanism, mercury switch and other components necessary for operation of the preferred sign.

Figure 4A:
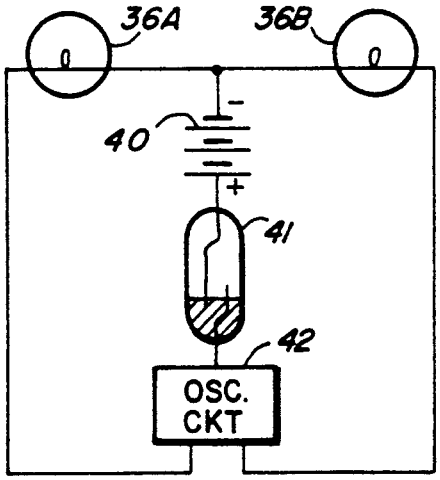
FIG. 4A is an electrical schematic for the preferred embodiment.

FIG. 4A is an electrical schematic for the preferred embodiment.

In the preferred embodiment, battery 40 is connected to mercury switch 41 which is activated when the sign is in a substantially up-right position. Oscillating circuit 42 switches the circuit between bulb 36A and bulb 36B.

In this manner, the lights are flashed one to the other and are only activated when the sign is in use (held upright).

Figure 4B:
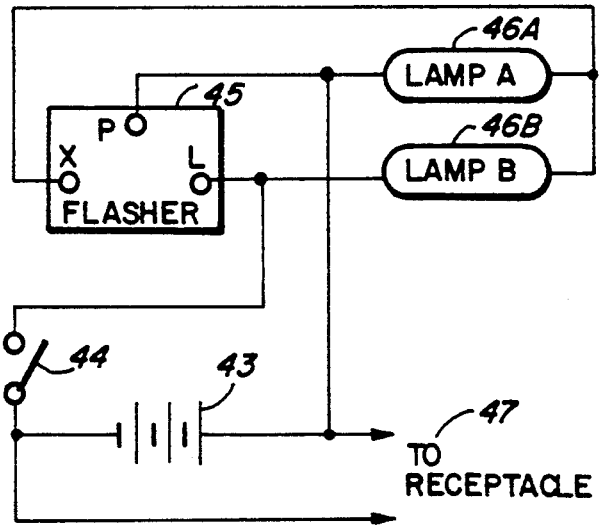
FIG. 4B is an electrical schematic of an alternative embodiment of the invention.

FIG. 4B is an electrical schematic of an alternative embodiment of the invention.

Either battery 43 or receptacle 47 provides electrical power for the system. Receptacle 47 connects either to an auxiliary battery pack or to an automobile battery (not shown). The system is activated through switch 44.

Flasher mechanism 45 controls the alternating activation of lamp A, 46A, and lamp B, 46B.

In this manner, electrical energy is properly communicated between the two lamps so that a flashing affect is obtained to gather more attention to the sign.

It is clear from the foregoing, the present invention creates a handheld sign with vastly improved safety features.

What is claimed is:

1. An illuminated sign comprising:

a) a sign portion having a first and second flat surfaces, each of said surfaces having,
   1) imprinted thereon a message, and,
   2) a first and a second window;

b) a first light emitting means for producing light positioned inside said sign portion to shine light through said first window of said first flat surface and said second flat surface;

c) a second light emitting means for producing light positioned inside said sign portion to shine light through said second window of said first flat surface and said second flat surface;

d) an electrical source; and, e) a control means for alternating electrical flow from said electrical source to said first light emitting means and said second light emitting means.

2. The illuminated sign according to claim 1 further including a handle portion attached to said sign portion and enclosing said electrical source.

3. The illuminated sign according to claim 2 wherein said handle portion further includes a manually operable switch for selective connection of said electrical source to said control means.

4. The illuminated sign according to claim 3 further including position sensing means for connecting said electrical source to said control means only when said illuminated sign is in a substantially upright position.

5. The illuminated sign according to claim 3 wherein said first and second flat surfaces are hexagonal in shape and wherein said message indicates stop.

6. The illuminated sign according to claim 3 further including means for recharging said electrical source.

7. The illuminated sign according to claim 6 wherein said means for recharging includes means for connecting said electrical source to a transformer receiving electrical energy from a household outlet.

8. The illuminated sign according to claim 6 wherein said means for recharging includes solar collector means for generating electricity from solar radiation.

9. The illuminated sign according to claim 3 wherein the first flat surface and said second flat surface are hinged permitting access to said first and second light emitting means.

10. A handheld sign comprising:

a) a sign portion having,
   1) a housing having a first and second flat surfaces, each of said flat surfaces having imprinted thereon a message,
   2) a first and a second window located on each of said flat surfaces,
   3) a first light emitting means for producing light positioned in said housing to shine light through the first window of both said first flat surface and said second flat surface,
   4) a second light emitting apparatus positioned in said housing to shine light through the second window of both said first flat surface and said second flat surface;

b) a handle attached to said housing and containing an electrical source; and, c) a control means for selectively alternating electrical flow from said electrical source to said first light emitting apparatus and said second light emitting apparatus.

11. The handheld sign according to claim 10 wherein said handle portion further includes a manually operable switch for selective connection of said electrical source to said control means.

12. The handheld sign according to claim 11 further including position sensing means for connecting said electrical source to said control means only when said handheld sign is in a substantially upright position.

13. The handheld sign according to claim 10 wherein said first and second flat surfaces are hexagonal in shape and wherein said message indicates stop.

14. The handheld sign according to claim 11 further including means for recharging said electrical source.

15. The handheld sign according to claim 14 wherein said means for recharging includes means for connecting said electrical source to a transformer receiving electrical energy from a household outlet.

16. The handheld sign according to claim 14 wherein said means for recharging includes solar collector means attached to said housing for generating electricity from solar radiation.

17. The handheld sign according to claim 11 wherein the first flat surface and said second flat surface are hinged permitting access to said first and said second light emitting means.

18. An illuminated sign comprising:

a) a sign portion having a first surface thereon, said first surface having imprinted thereon a message;

b) at least two window means positioned on the periphery of said first surface of said sign portion for permitting light to shine out from the interior of said sign portion;

c) at least two light emitting means for producing light positioned inside said sign portion to shine light through said at least two window means; and, d) a control means for operation of one of said at least two light emitting means at a time.

19. The illuminated sign according to claim 18 further including a handle portion attached to said sign portion, said handle portion including:

a) an electrical source; and, b) an operator controlled switch for selectively communicating electrical energy from said electrical source to said control means.

20. The illuminated sign according to claim 19 further including position sensing means for connecting said electrical source to said control means only when said illuminated sign is in a substantially upright position.

21. The illuminated sign according to claim 18 wherein said first flat surface is hexagonal in shape and wherein said message indicates "stop".

22. The illuminated sign according to claim 19 further including means for recharging said electrical source.

23. The illuminated sign according to claim 22 wherein said means for recharging includes means for connecting said electrical source to a transformer receiving electrical energy from a household outlet.

24. The illuminated sign according to claim 22 wherein said means for recharging includes solar collector means for generating electricity from solar radiation.

* * * * *